US007685956B2

(12) United States Patent
Hynes

(10) Patent No.: US 7,685,956 B2
(45) Date of Patent: Mar. 30, 2010

(54) RUB RAIL WITH SELF-CONTAINED TRIM AND METHODS FOR MANUFACTURING AND INSTALLING THE RUB RAIL

(75) Inventor: Richard K. Hynes, East Bridgewater, MA (US)

(73) Assignee: Barbour Plastics, Inc., Brockton, MA (US)

( * ) Notice: Subject to any disclaimer, the term of this patent is extended or adjusted under 35 U.S.C. 154(b) by 0 days.

(21) Appl. No.: 11/515,124

(22) Filed: Sep. 1, 2006

(65) Prior Publication Data

US 2007/0137545 A1 Jun. 21, 2007

Related U.S. Application Data

(60) Provisional application No. 60/713,915, filed on Sep. 1, 2005.

(51) Int. Cl.
*B63B 59/02* (2006.01)

(52) U.S. Cl. ..... 114/219

(58) Field of Classification Search ..... 114/219; 293/128

See application file for complete search history.

(56) References Cited

U.S. PATENT DOCUMENTS 4,292,913 A 10/1981 Siebert et al.
4,318,764 A * 3/1982 VanManen ..... 156/244.11
4,349,592 A * 9/1982 Nussbaum ..... 428/31
4,808,450 A * 2/1989 Guy ..... 428/31
5,139,830 A * 8/1992 Gross ..... 428/31
5,453,309 A 9/1995 Shanok et al.
5,456,786 A * 10/1995 Cook et al. ..... 156/244.19
5,641,547 A * 6/1997 Dilley ..... 428/31
5,730,077 A * 3/1998 Nunes et al. ..... 114/219
6,349,662 B1 * 2/2002 Limansky et al. ..... 114/219
6,416,095 B1 * 7/2002 Keys et al. ..... 293/128
6,733,161 B2 5/2004 Tufte
6,776,114 B2 8/2004 Abe
6,843,192 B1 1/2005 Nugteren et al.
6,863,009 B1 3/2005 Driver
2004/0200397 A1 * 10/2004 Klein ..... 114/219
2006/0016378 A1 1/2006 Limansky

* cited by examiner

*Primary Examiner*—Ed Swinehart
(74) *Attorney, Agent, or Firm*—Steven M. Jensen; Edwards Angell Palmer & Dodge LLP

(57) ABSTRACT

A rub rail for a boat, and methods of manufacturing and installing the rub rail on the boat are provided. The rub rail includes a base polymer and a metal trim embedded or integrated into the base. The metal trim can be made of stainless steel to maximize aesthetic appearance. The metal trim and base polymer are combined during an extrusion process such that substantially no gaps are formed between the metal trim and base. The base polymer optionally can include a non-visible body portion made of recycled material. The rub rail is formed as a single piece which can be installed easily by screws or adhesive tape to a boat.

11 Claims, 7 Drawing Sheets

RUB RAIL WITH SELF-CONTAINED TRIM AND METHODS FOR MANUFACTURING AND INSTALLING THE RUB RAIL

CROSS-REFERENCE TO RELATED APPLICATION(S)

The present application claims the benefit of U.S. provisional application No. 60/713,915 filed Sep. 1, 2005, which is incorporated herein by reference in its entirety.

FIELD OF INVENTION

The present invention relates to rub rails for boats or ships, and more particularly to a rub rail in which a metal trim is embedded in a base, and methods for manufacturing and installing the rub rail on a boat.

BACKGROUND OF THE INVENTION

Rub rails are conventionally provided on boats and ships, where a rub rail is usually installed along an outside upper edge of the hull and around the bow and stem. The rub rail functions to protect the hull when the boat or ship bumps against an object such as the sides of a wharf where the boat or ship is docking. Rub rails can be fabricated from wood, where the wood is crafted to fit a particular boat or ship. Because of the large expense of using wood, many rub rails, in particular replacement rub rails, are made of stainless steel, aluminum, and vinyl.

Stainless steel rub rails provide maximum durability and are desirable because of their decorative appearance. Traditionally, stainless steel capped rub rails have been reserved for higher-end boats, as rub rails incorporating stainless steel generally are more expensive than vinyl rub rails provided either with or without flexible vinyl inserts. Stainless steel trims used today typically are solid, dome-shaped cross sections or hollow-back crescent shapes, which are highly polished for maximizing aesthetics. One or both of these shapes are available from metals manufacturers or distributors in a "pre-drilled and countersunk" form, which speeds installation by saving the installer the need to drill holes in the metal trim.

Regardless of the shape of metal trim to be used, the installation begins with the application of an extruded polymer base having a bottom surface shape to fit the shape of the deck or hull of a boat, and a top surface shape with an opening to accept the metal trim or insert. This base extrusion can be an extruded rigid or semi-rigid polymer. The conventional installation procedure is a two-step process. First, the rigid base is affixed to the gunwale (e.g., deck or hull) of the boat with screws. Next, metal trim, such as stainless steel trim, is bent around the gunwale onto the polymer base and screwed to the base using stainless steel screws. If more than one piece of rub rail base is employed to cover the gunwale, care must be taken that any butt joints in the base do not line up with butt joints of multiple pieces of the trim. Thus, installation can be an arduous, time-consuming process requiring a skilled installer who must carefully plan the installation.

An example of an extruded rub rail is disclosed in U.S. Pat. No. 6,349,662 to Limansky et al., in which an extruded insert is made from a plastic material and attached by screws to an extruded molding trim. U.S. Pat. No. 6,349,662 is incorporated by reference herein. According to Limansky et al., the insert is covered by a strip-like portion fabricated from a clear transparent material, which encapsulates a metallic-like strip made of MYLAR or a similar material. The metallic-like strip provides a decorative outer appearance. In Limansky et al., the molding trim and insert are configured such that the molding trim will initially contact any outside object. The molding trim includes free end portions which extend in a plane above the insert, thus shielding the insert. However, in most installations, it would be desirable for the insert to extend above the base or molding trim, so that the insert can absorb any blow from an object.

Another example of a rub rail is disclosed in U.S. Pat. No. 6,863,009 to Driver, in which a center member is formed above a base strip. U.S. Pat. No. 6,863,009 is incorporated by reference herein. According to Driver, the center member is formed from a more rigid material than the base strip, where the center member can be made of KEVLAR, MYLAR, or stainless steel. The center member includes fasteners for clipping onto the base strip, instead of the threaded attachment required in other rub rails. A second embodiment disclosed in Driver utilizes a protruding rib on the center member to engage a groove in the base strip. In Driver, some type of fastener is-required to attach the center member to the base strip.

It would be desirable to provide a rub rail having a self-contained metal trim which is made integral with a base. It would also be desirable to incorporate the metal trim during an extrusion step in the manufacturing process. Further, it would be desirable to simplify a procedure for installing the rub rail on a boat or ship. The rub rail and manufacturing and installation methods should overcome the deficiencies of presently available rub rails and methods.

SUMMARY OF THE INVENTION

A rub rail according to the present invention is configured to be installed on a boat or ship, and the present invention also encompasses methods of manufacturing the rub rail and installing the rub rail on the boat or ship. The rub rail preferably is manufactured as a single piece, incorporating a base and a metal trim integrated or embedded in the base, the single piece capable of being installed easily on the gunwale, i.e., deck or hull of a boat. The metal trim preferably is made of stainless steel, and can be embedded in a polymer base by extrusion or another known manufacturing process. For example, during manufacturing, the metal trim can be fed through a die and extruded into the polymer base. By virtue of this polymer-metal combination made during extrusion or other process, substantially no gaps are formed between the metal trim and polymer base of the rub rail. The rub rail of the present invention with the metal trim integrated into the base during manufacturing distinguishes from prior art arrangements in which the metal trim and base are provided as separate components, and require assembly in the field.

A rub rail according to the present invention preferably includes the metal trim and the polymer base, which substantially are incapable of being separated after manufacture without destroying the rub rail. The metal trim preferably is made of stainless steel to maximize aesthetic appearance. The polymer base can include a body portion and first and second end portions, where the end portions are made of new or virgin material, while the body portion is not visible upon installation, and thus can be made of either new or recycled polymer material. In certain embodiments, the first and second end portions can be formed with at least one section of enlarged thickness. The enlarged thickness sections can facilitate anchoring of the metal trim into the body portion of the base and/or the end portions.

The rub rail can be formed with holes for receiving screws, where the holes preferably are pre-drilled and countersunk, and extend through both the metal trim and base. The holes are configured to allow for installation in a single step, merely by screwing the rub rail into corresponding holes in the deck and/or hull of a boat. Optionally, a pressure sensitive tape and release liner can be affixed to the bottom of the rub rail for attaching to the boat with or without the aid of one or more screws and holes.

Embodiments of a rub rail according to the present invention include at least a polymer base and a metal trim embedded in the base, such that substantially no gaps are formed between the metal trim and the polymer base. The polymer base and the metal trim preferably form a single piece to facilitate attachment to the boat.

A method for manufacturing a rub rail according to the present invention includes steps of: providing a strip of metal, forming the strip into a correct or desired shape, feeding the shaped strip into a die head, injecting extruded polymer into the die head, embedding the strip of metal into the extruded polymer, and allowing the strip of metal to become fixed in the extruded polymer, thereby forming the rub rail of a desired shape.

A method of installing a rub rail on a boat, according to the present invention includes steps of: providing a polymer base and a metal trim embedded in the base, such that substantially no gaps are formed between the metal trim and the polymer base, and attaching the polymer base and metal trim to a deck or hull of the boat.

Other aspects and embodiments of the invention are discussed below.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein.

DEFINITIONS

The instant invention is most clearly understood with reference to the following definitions:

As used in the specification and claims, the singular form "a", "an" and "the" include plural references unless the context clearly dictates otherwise.

As used herein, the terms "boat" and "ship" are used interchangeably, and refer to any watercraft, with or without a motor, which are capable of being fitted with a rub rail.

DETAILED DESCRIPTION OF THE INVENTION

A rub rail for a boat or ship, and methods of manufacturing the rub rail and installing the rub rail on the boat or ship are provided. A rub rail according to the present invention preferably is provided as a single piece, incorporating a base and a metal trim integrated or embedded in the base, the single piece capable of being installed easily along the gunwale, i.e., the deck and/or hull, of a boat or ship. The metal trim preferably is made of stainless steel, and is embedded in the base during a manufacturing process, in particular by feeding the metal trim through a die during extrusion of the polymer base, such that substantially no gaps are formed between the metal trim and the base. The base preferably is made of a rigid or semi-rigid polymer material, and incorporates new and/or recycled material.

Figure 1:
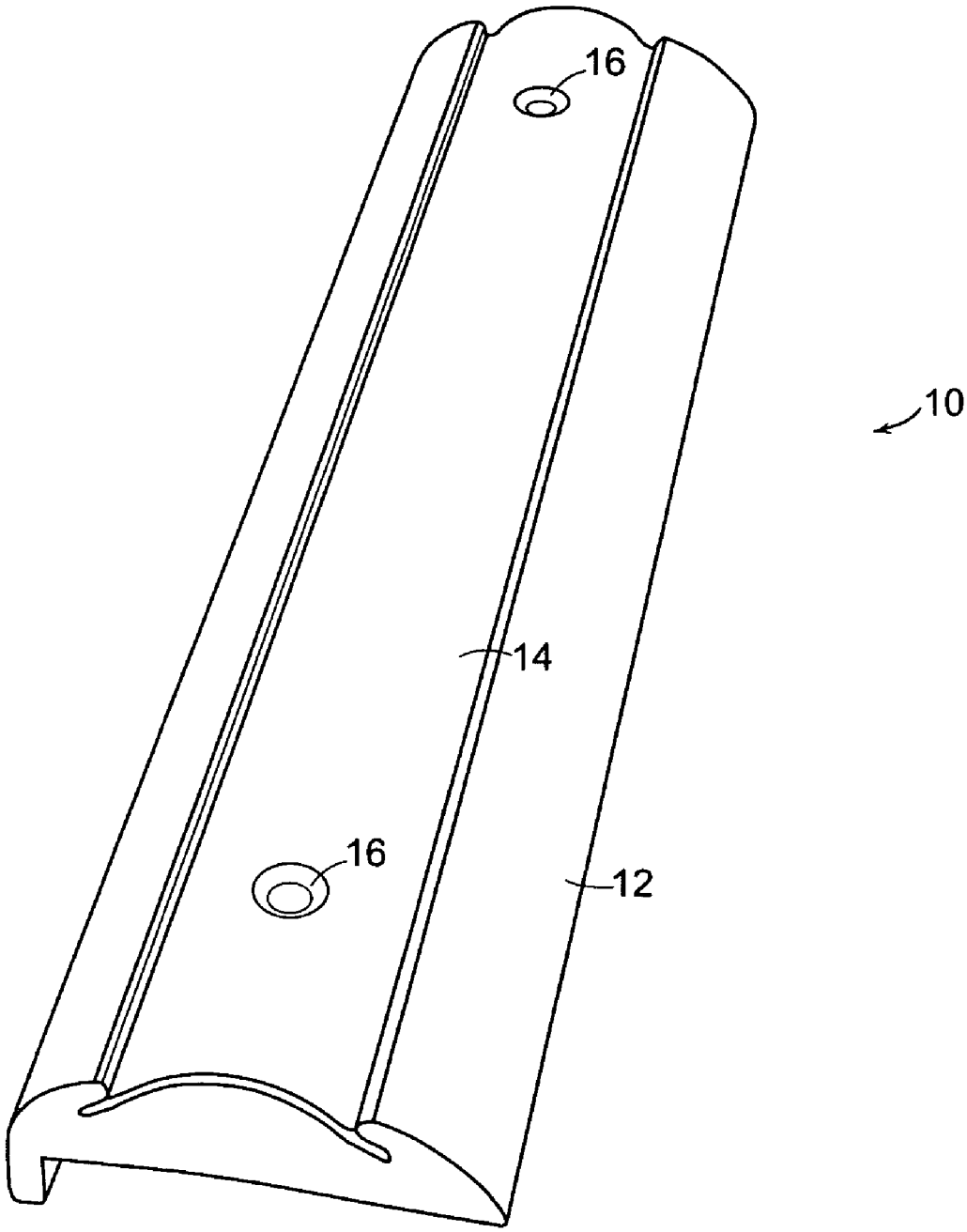
FIG. 1 is a perspective view of a rub rail according to the present invention.
Figure 2:
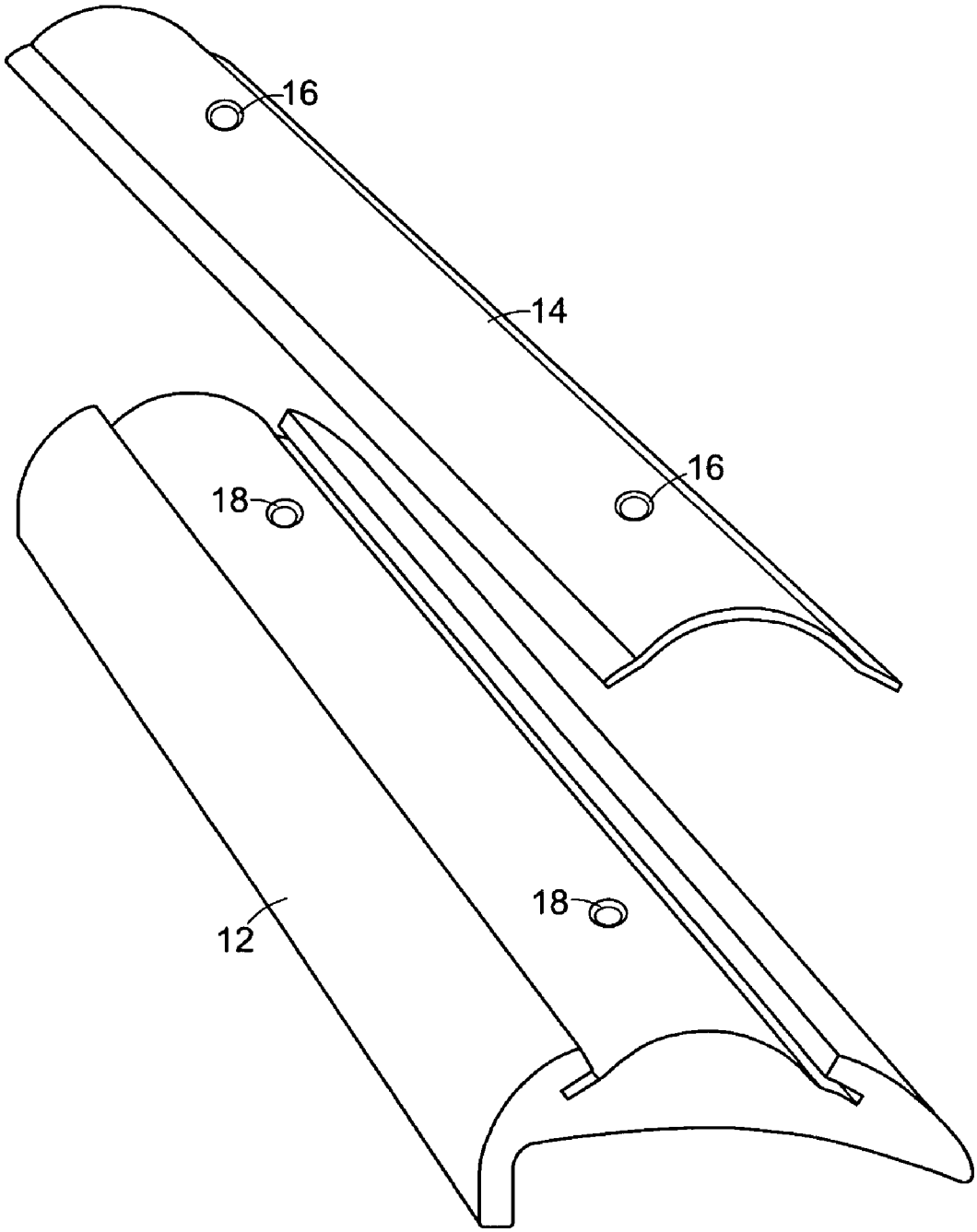
FIG. 2 is an exploded parts view of the rub rail of FIG. 1.

As shown in FIGS. 1 and 2, a rub rail 10 according to the present invention includes a base 12 and a metal trim 14 formed integrally with the base 12. The metal trim 14 preferably is made of stainless steel or another metal such as aluminum, and has a bright, shiny appearance to enhance aesthetic appeal.

As a result of the manufacturing process, as described in detail herein, the metal trim 14 becomes integrated or embedded in the base 12, such that the metal trim 14 cannot be removed or separated from the base 12 without damaging the rub rail 10. FIG. 2 merely illustrates the individual parts of the rub rail, and is not meant to indicate that the base and metal trim are separable.

The metal trim 14 preferably includes one or more holes 16, which can be pre-drilled and countersunk during the manufacturing process. Corresponding holes 18 in the base 12 preferably are drilled and countersunk, the holes 16 and 18 configured to receive screws made of stainless steel or another metal, preferably the same material as the metal trim 14. During installation of the rub rail 10, the screws can pass through corresponding holes 16 and 18, and are threaded into corresponding holes formed in the deck and/or hull of a boat. For example, referring to FIG. 5, the rub rail is shown attached to the deck 30 and/or hull 32 of a boat.

Figure 3:
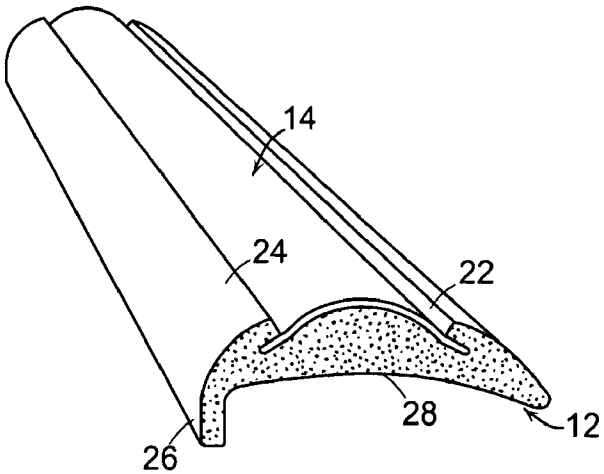
FIG. 3 is a perspective view of a rub rail according to the present invention in which screw holes have been removed for simplicity.
Figure 4:
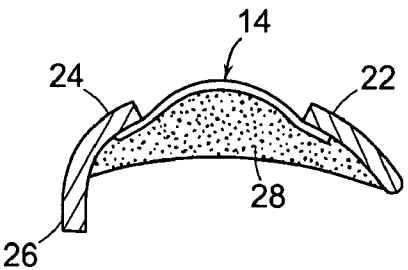
FIG. 4 is a cross-sectional end view of the rub rail of FIG. 3.
Figure 5:
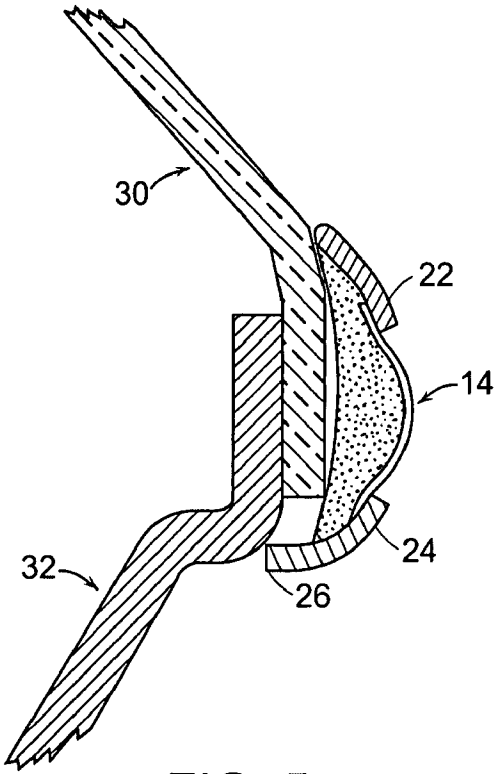
FIG. 5 is a cross-sectional end view of the rub rail of FIG. 3 attached to the hull and deck of a boat.

FIGS. 3-5 illustrate additional details of the rub rail according to the present invention. The base 12 of the rub rail preferably includes at least a body portion 28, and first and second end portions 22 and 24, respectively. In the embodiment depicted in FIGS. 3-5, the end portions 22 and 24 have substantially a uniform thickness. However, in other embodiments, the end portions 22 and 24 may have a section of greater thickness that is configured for receiving the metal trim 14. The second end portion 24 preferably terminates in a flange 26 configured to engage the hull 32 of a boat (see FIG. 5).

As shown in FIG. 4, for example, the metal trim 14 is embedded between the first and second end portions 22 and 24 and the body portion 28 of the base 12. The metal trim 14 is made integral with the base 12 during the process for manufacturing the rub rail, so that substantially no gaps or apertures are formed between the metal trim 14 and the various parts of the base 12. After the metal trim 14 is attached to the base 12, it is not possible to remove the metal trim 14 from the base 12 without damaging or destroying the rub rail. The metal trim 14 can be formed in a crescent or curved shape, and includes ends that preferably engage at least the underside of the first and second end portions 22 and 24. The metal trim 14 may engage other parts, such as the middle or interior, of the first and second end portions.

Various embodiments of a rub rail are depicted in FIGS. 6-9 and 11-13, respectively. These embodiments differ based on the type of material provided in the base and/or the manner in which the base is affixed to the boat, or the manner in which the metal trim is connected to the base and/or first and second end portions.

Figure 6:
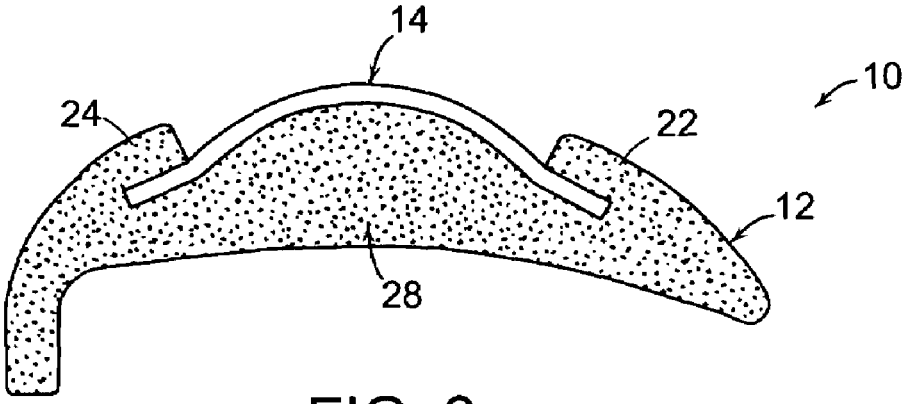
FIG. 6 is a cross-sectional end view of an embodiment of the rub rail.

As shown in FIG. 6, an embodiment of the rub rail includes new or virgin material in both the first and second end portions 22 and 24, and the body portion 28 of the base 12 of the rub rail 10. As described herein, a single extruder can be used in the manufacturing process when only one type of material is used in the base. In accordance with FIG. 6, although not depicted in the cross-sectional view, holes can be drilled in the metal trim 14 and the base 12 for attaching the rub rail 10 to the deck and/or hull of a boat. A suitable attachment mechanism is described above with reference to FIGS. 1 and 2.

Figure 7:
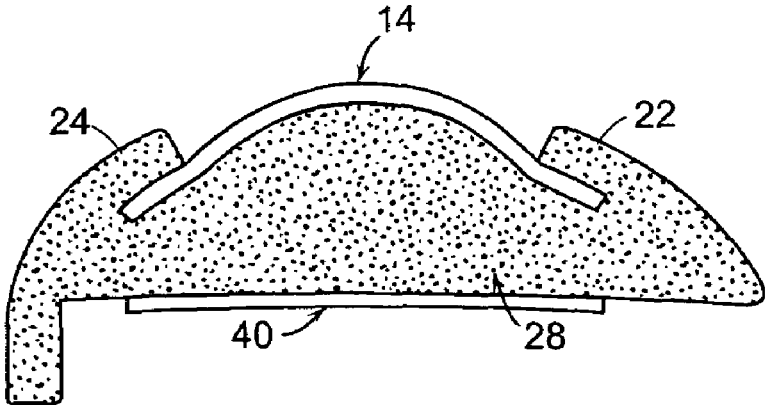
FIG. 7 is a cross-sectional end view of another embodiment of the rub rail similar to FIG. 6, in which a pressure sensitive tape is affixed to the bottom of the rub rail.

Referring to FIG. 7, an embodiment of the rub rail is shown which is similar to FIG. 6, but further includes a pressure sensitive tape 40 affixed to the bottom of the body portion 28 of the base. The pressure sensitive tape 40 preferably is a very high bond (VHB) tape having a release liner. The pressure sensitive tape 40 can serve as the sole mechanism for attaching the rub rail to the deck and/or hull of a boat. Optionally, an attachment mechanism including holes drilled through the metal trim 14 and the base 12 can supplement the pressure sensitive tape 40, preferably by providing one set of holes at each end of the rub rail. By utilizing the pressure sensitive tape 40, it is possible to reduce or eliminate the appearance of screws passing through holes in the rub rail.

Figure 8:
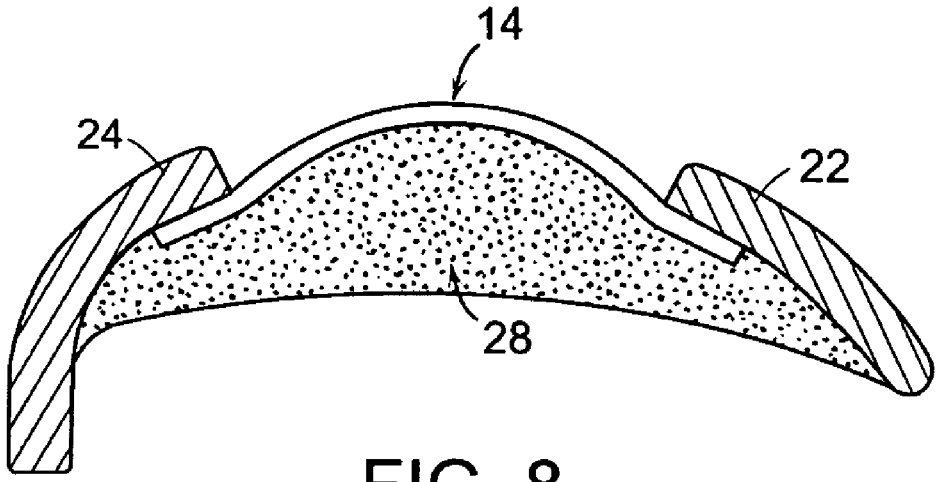
FIG. 8 is a cross-sectional end view of a further embodiment of the rub rail incorporating recycled material in the base.
Figure 9:
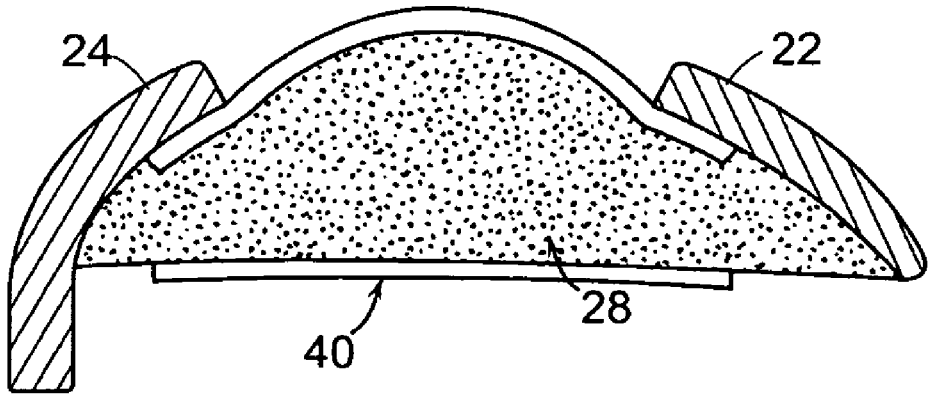
FIG. 9 is a cross-sectional end view of an embodiment of the rub rail similar to FIG. 8, in which a pressure sensitive tape is affixed to the bottom of the rub rail.

FIGS. 8 and 9 depict embodiments of the rub rail which utilize recycled polymer material in the body portion 28 of the base of the rub rail. By incorporating recycled material in the body portion 28 of the rub rail, it is possible to reduce material costs without affecting aesthetics, since the body portion 28 of the base is not visible when the rub rail is installed on a boat. When recycled material is provided in body portion 28, a second extruder is utilized in the manufacturing process, as explained hereafter.

Figure 12:
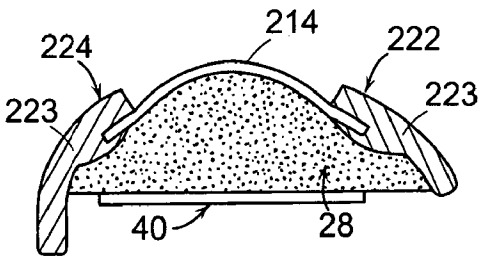
FIGS. 11-13 are cross-sectional end views of embodiments of the rub rail in which first and second end portions each have an enlarged thickness section so as to anchor the metal trim.
Figure 11:
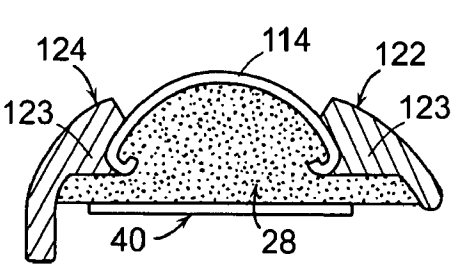
Figure 13:
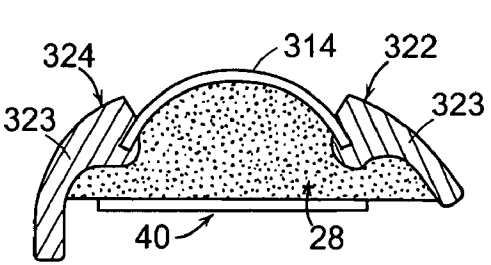

FIGS. 11-13 depict further alternate embodiments of the rub rail, in which the first and second end portions each are formed with at least one section having an enlarged thickness, as compared to the substantially uniform thickness of the end portions as described with reference to previous embodiments. The enlarged thickness sections can facilitate anchoring of the metal trim into the body portion of the base and/or the end portions. In each of these embodiments, the pressure sensitive tape 40 is affixed to the bottom of the body portion 28 of the base.

Referring to FIG. 11, the rub rail includes a metal trim 114 embedded in the body portion 28 of the base, and first and second end portions 122 and 124. The first and second end portions 122 and 124 are similar to the first and second end portions 22 and 24 depicted in previous embodiments. However, in FIG. 11, the end portions 122 and 124 each include an enlarged thickness section 123 configured to receive ends of the metal trim 114. The metal trim 114, as compared to the metal trim 14 depicted in previous embodiments, includes inwardly curled ends that provide an anchoring effect with the first and second ends 122 and 124, and the body portion 28 of the base.

In the embodiment of FIG. 12, the rub rail includes a metal trim 214 substantially similar to the metal trim 14 described with reference to earlier embodiments. However, first and second end portions 222 and 224 each include an enlarged thickness section 223 configured to receive ends of the metal trim 214 within the enlarged thickness section 223. In other words, in FIG. 12, the ends of the metal trim 214 are received or anchored by the enlarged thickness sections 223 of the first and second end portions 222 and 224, respectively.

According to the embodiment of FIG. 13, the rub rail includes a metal trim 314 formed in approximately an arc shape, such that ends of the metal trim 314 are received in enlarged thickness sections 223 of first and second end portions 322 and 324.

Figure 10:
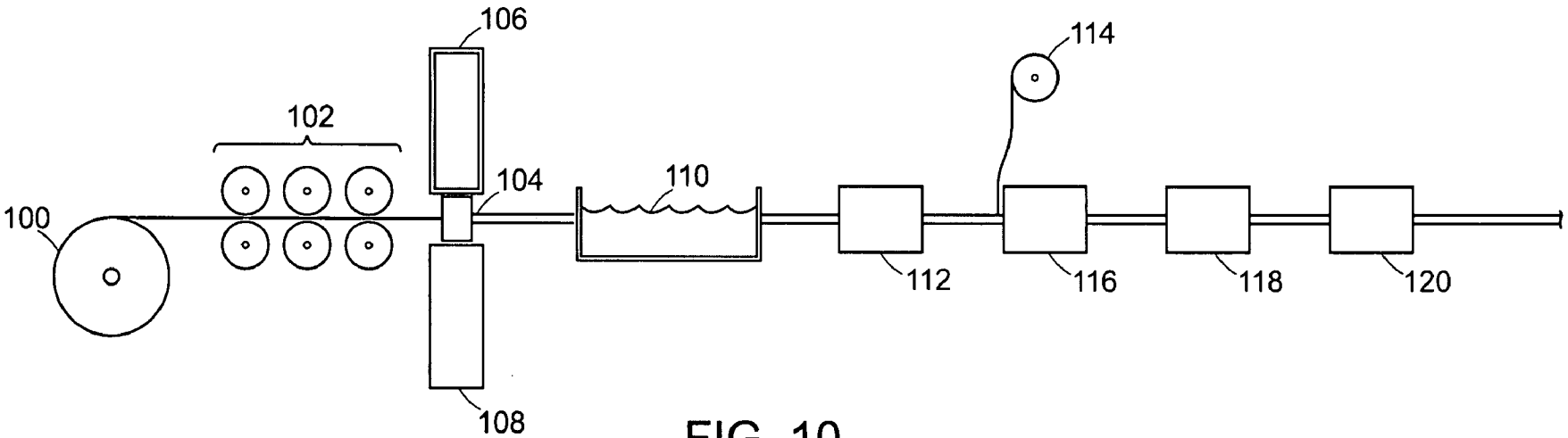
FIG. 10 is a schematic view of a process for manufacturing a rub rail according to the present invention.

A method for manufacturing a rub rail according to the present invention will be described with reference to FIG. 10. According to the method, a flat strip of metal, such as stainless steel, is fed from a metal coil 100 into a series of forming or shaping rollers 102. One or more sets of rollers 102 are provided along the feed path, where three such sets of rollers are depicted in FIG. 10. Each set of rollers includes at least two rollers that receive the strip of metal in a nip of the rollers. The sets of rollers 102 progressively form the flat strip into a shape which generally resembles a crescent or curve corresponding to the desired final shape of the metal trim 14, although the flat strip can be formed in any desired shape.

The formed strip of metal is then fed into an extrusion tool 104, which includes a die head, preferably a cross-head die. The metal strip is inserted through the cross-head die such that the metal strip comes into contact with melted polymer fed by an extruder 106. Virgin or new polymer material is fed through the extruder 106, where the extruder 106 can be the only extruder used in the manufacturing process when the rub rail is provided with only virgin or new polymer material.

In embodiments which utilize recycled material, co-extrusion is effected by providing a second extruder 108. To manufacture such embodiments of the rub rail, virgin material is fed through the first extruder 106, and recycled material is fed through the second extruder 108, thereby providing a co-extrusion. The second extruder 108 is arranged such that its output nozzle is directly affixed to the cross-head die of the extrusion tool 104 so as to feed an appropriate amount of recycled polymer through the tool, which in turn channels the flow to an appropriate area of the extruded polymer-metal combination.

While the metal strip is resident in the extrusion tool 104, each edge of the metal strip becomes embedded or encased in the polymer extrusion, and the metal is precisely supported by the base polymer as a result of the configuration of the cross-head die of the extrusion tool 104. An outer shape of the base of the rub rail also forms as a result of contact between the extruded polymer material and the die head of the extrusion tool 104. The extruded combination of polymer base and metal strip, while remaining fixed in the die head, passes into a vacuum calibration zone (not shown) where the hot polymer begins to cool, and the final shape of the rub rail is fixed. The extruded combination then passes through a cooling bath 110 for a suitable length of time, preferably until sufficient heat has been extracted from the combination to ensure integrity of the final shape. The extruded polymer-metal combination is drawn through the cooling bath 110 and removed from the die head by using a pulling device 112. The various components used in the manufacturing process are operated at appropriate speeds to ensure coordination between the components, and provide negligible speed variation. Digital electronic sensors optionally connected to a central controller can be used to monitor the speed of operating components, and to provide feedback to ensure appropriate speed coordination.

According to embodiments in which the rub rail is attached to the deck and/or hull of a boat using screws, holes can be drilled at a point in the manufacturing process where the polymer material has cooled sufficiently to ensure shape stability. In particular, as an end of the rub rail exits the cooling bath 110, holes are drilled entering through the metal trim at the top of the rub rail and exiting through the base. The holes are drilled to an appropriate diameter which allows clearance for screws used in conjunction with a particular size of rub rail. Also, it is possible to drill several holes at a time using multi-spindle equipment. The tool components of a drilling apparatus 118 are configured to drill each hole and countersink the hole to accept the taper of a screw in a single operation. The operation can be performed by a system in which drilling heads are mounted on a carriage which is configured to move with the polymer-metal extrusion at line speed. The length of travel of the carriage can be equal to or greater than the time necessary to complete the drilling cycle. As such, all necessary holes, which preferably are spaced about four to six inches centered on the rub rail, can be drilled on a continuous basis without requiring the line to stop.

According to embodiments in which a pressure sensitive tape is affixed to the bottom of the rub rail, the manufacturing process continues by applying preferably a very high bond (VHB) tape to the rub rail base after the polymer-metal combination has been pulled from the cooling bath 110. A tape application fixture 116 is placed in line and oriented with the linear direction of travel of the extruded polymer-metal combination. The tape application fixture 116 holds a coil 114 of the VHB tape, and dispenses the tape which is pressed onto the rub rail base by rubber rollers (not shown) contained in the tape application fixture 116. If holes are to be drilled, e.g., at ends of the rub rail, then drilling is performed by the drilling apparatus 118.

A rub rail of the desired length is cut by a cutting device 120, which is the final machine station in the line for manufacturing the rub rail. The cutting device 120, similar to the drilling apparatus 118, preferably is carriage mounted, and thus has the ability to move at line speed for the duration of the cut.

According to the above-described manufacturing process, a metal trim is made integral with a polymer base by inserting a metal strip directly into an extrusion tool, such that the metal strip becomes embedded in melted polymer material. After subsequent cooling, the metal trim becomes fixed in the polymer base, without forming gaps between the metal trim and the polymer base. The rub rail is thus formed as a single piece including the metal trim and the polymer base, where the polymer base optionally can include recycled material in non-visible portions of the base.

Because the rub rail is formed as a single piece, a method of installing the rub rail on the deck and/or hull of a boat is simplified. The rub rail can be installed in a single step, simply by screwing the rub rail into the deck and/or hull of a boat, or in certain embodiments, removing a release liner and attaching the rub rail by use of an adhesive tape.

A metal trim used in the rub rail according to the present invention preferably is made of a thinner gauge than traditional post-installation trim. By using a thinner metal, it is possible to reduce material costs. Further, the manufacturing process is simplified by permitting use of large coils of metal stock, as compared to traditional metal having a thickness of about 0.066 to 0.077 inches for hollow back metal. The use of a thinner gauge metal stock also allows the surface of the polymer base to be formed precisely in accordance with the degree of curvature of the metal, thus more efficiently cradling the metal, as compared to a traditional system in which the base merely approximates the shape of the metal trim. This more secure support of the metal also can prevent impact damage and dents.

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications and other references cited herein are hereby expressly incorporated herein in their entireties by reference.

What is claimed is:

1. A rub rail, comprising:

a polymer base having at least a body portion and first and second end portions;

a metal trim embedded in the base, such that substantially no gaps are formed between the metal trim and the polymer base; and the first and second end portions utilizing different types of materials from the body portion of the polymer base and formed over respective end portions of the metal trim, the first and second end portions each having a substantially uniform thickness portion and further including a portion having a thickness greater than said uniform thickness portion engaged with the metal trim for anchoring the metal trim to the base of the rub rail, wherein the polymer base and the metal trim are formed with at least one hole for receiving a screw.

2. The rub rail of claim 1, wherein the polymer base and the metal trim are attached to a hull or deck of a boat by attaching the screw.

3. The rub rail of claim 1, wherein the rub rail is attached to a hull or deck of a boat by affixing a pressure sensitive adhesive or a pressure sensitive adhesive tape to a bottom of the rub rail.

4. The rub rail of claim 1, wherein the metal trim is made of stainless steel.

5. The rub rail of claim 1, wherein the polymer base incorporates recycled material.

6. The rub rail of claim 1, wherein the body portion is made of new or virgin material.

7. The rub rail of claim 1, wherein the body portion is made of recycled material.

8. The rub rail of claim 1, wherein the metal trim is embedded in the polymer base by extrusion.

9. The rub rail of claim 1, wherein the metal trim and the polymer base are formed as a single piece without gaps during manufacturing.

10. A rub rail, comprising:

a polymer base having a body portion that incorporates recycled material, and first and second end portions;

a metal trim embedded in the base, such that substantially no gaps are formed between the metal trim and the polymer base; and the first and second end portions utilizing different types of materials from the body portion of the polymer base and formed over respective end portions of the metal trim, the first and second end portions each having a substantially uniform thickness portion and further including a portion having a thickness greater than said uniform thickness portion engaged with the metal trim for anchoring the metal trim to the base of the rub rail, wherein the polymer base and the metal trim are formed with at least one hole for receiving a screw.

11. A rub rail, comprising:

a polymer base having at least a body portion and first and second end portions;

a metal trim embedded in the base, such that substantially no gaps are formed between the metal trim and the polymer base; and the first and second end portions utilizing different types of materials from the body portion of the polymer base and formed over respective end portions of the metal trim, the first and second end portions each having a substantially uniform thickness portion and further including a portion having a thickness greater than said uniform thickness portion engaged with the metal trim for anchoring the metal trim to the base of the rub rail, wherein the polymer base and the metal trim are formed with at least one hole for receiving a screw, and the polymer base and the metal trim are attached to a hull or deck of a boat by attaching the screw.

* * * * *